US005361559A

United States Patent [19]

Fauciglietti

[11] Patent Number: 5,361,559

[45] Date of Patent: Nov. 8, 1994

[54] ASSEMBLABLE FRAME FOR DOORS, SLIDING DOORS AND SIMILAR OF VENEERED TYPE WITH PREFABRICATED COMPONENTS AND RELEVANT METHOD

[75] Inventor: Renzo Fauciglietti, Cantû, Italy

[73] Assignee: Fauciglietti Engineering S.r.l., Cantu, Italy

[21] Appl. No.: 75,676

[22] Filed: Jun. 11, 1993

Related U.S. Application Data

[62] Division of Ser. No. 846,789, Mar. 4, 1992, Pat. No. 5,236,392.

[51] Int. Cl.[5] ..... E04G 21/00

[52] U.S. Cl. ..... 52/746; 29/897.32

[58] Field of Search ..... 52/746; 29/897.32, 467; 156/292, 300

[56] References Cited

U.S. PATENT DOCUMENTS

| | | | |
|---|---|---|---|
| 3,327,826 | 5/1967 | Lowy | 29/897.32 X |
| 5,125,155 | 6/1992 | Kyle et al. | 29/897.32 |
| 5,161,346 | 11/1992 | Olson et al. | 52/546 |
| 5,191,704 | 3/1993 | McCarty | 29/897.32 |

*Primary Examiner*—Carl D. Friedman
*Assistant Examiner*—Creighton Smith
*Attorney, Agent, or Firm*—Herbert Dubno

[57] ABSTRACT

A frame for a door or the like has a multiplicity of cross members formed with outer surfaces as supports for finishing panels and having their ends matingly engaged with joints formed by longitudinal sections forming the opposite longitudinal edges of the door and having seats engaging the panels.

6 Claims, 3 Drawing Sheets

ASSEMBLABLE FRAME FOR DOORS, SLIDING DOORS AND SIMILAR OF VENEERED TYPE WITH PREFABRICATED COMPONENTS AND RELEVANT METHOD

This is a divisional of co-pending application Ser. No. 07/846,789 filed on Mar. 4, 1992 now U.S. Pat. No. 5,236,392.

FIELD OF THE INVENTION

The present invention relates to an assemblable frame for producing panels, doors and the like of the so-called veneered type.

BACKGROUND OF THE INVENTION

It is known that in joinery practice it is possible to make panels, sliding doors, doors and the like of the so-called veneered type, that is, consisting of a series of cross-members produced in various configurations, dimensions and materials, the ends of which terminate in an edgeframe that stiffens the frame thus formed, to which there are then glued flat covering layers such as sheets of plywood, veneers and the like.

Such technique makes it possible to obtain panels of very low weight with a high degree of finish and stability over in the course of time. However, because of the difficulty of implementing such technique, which calls for highly skilled personnel, precision work and careful selection of the materials to be joined, resulting in high costs, the technique has in practice become obsolete.

OBJECT OF THE INVENTION

It is the object of the invention to provide an improved door frame capable of being assembled in an easy and reproducible manner, even by unskilled personnel, to which it is possible to apply in a likewise easy, quick and reproducible manner finishing layers for the purpose of forming doors, panels, sliding doors or the like of the so-called veneered type.

The frame according to the invention should moreover be made of inexpensive materials readily available on the market and easy to shape according to the desired features and dimensions, even outside normal standards.

SUMMARY OF THE INVENTION

This object is attained according to this invention by a frame for doors, sliding doors and the like of veneered type which consists of a multiplicity of cross-members, suitably formed and capable of constituting, by means of their outer surface, supports for finishing panels, the free ends of which have joining devices capable of engaging with the matching joining devices of sections extending lengthwise over the full height of the door or the like and provided with shaped seats capable of overlapping the free edges of such panels in order to cooperate in the retention thereof and impart protection thereto.

More particularly, the frame for doors according to the invention has its cross members constructed with an internal lattice structure stiffened transversal by a flat member and the cross-members have a plan of substantially elliptical form relative to the longitudinal axis in order to make possible the production of doors with convex surfaces, or a plan of substantially rectangular symmetrical form relative to the longitudinal axis for the production of doors and the like with flat surfaces.

According to a further feature of the invention the longitudinal sections are of symmetrical form relative to a transverse axis and are provided with seats for the reversible fitting of hinges arranged in such a way as to allow the operation of the door with right-hand or left-hand hingeing and inward or outward opening.

The invention also relates to a method of producing a door or the like by means of a frame according to the foregoing description which comprises the following phases:

a) preparation of cross-members of suitable form in plan and with lateral edges ready for gluing;
b) presetting in a horizontal plane of a first flat-surface panel;
c) supporting, at preset intervals, or plurality of such cross-members with their lower edge on the flat surface of such first panel;
d) supporting of a second flat-surface panel on the upper surface of such cross-member;
e) bending of both panels to a preferred shape, for example with a
flat, convex or concave surface;
f) gluing of the panels to such cross-members with possible curvature of the surfaces;
g) application of the longitudinal sections to the flanks of the door thus obtained; and
h) finishing of the external surface of the panels.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
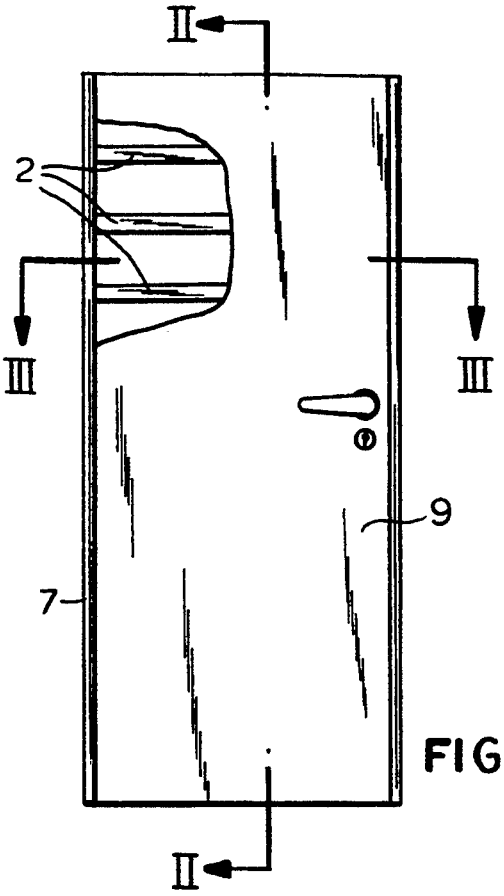
FIG. 1 is a cutaway view of a door made with a frame according to this invention.
Figure 2:
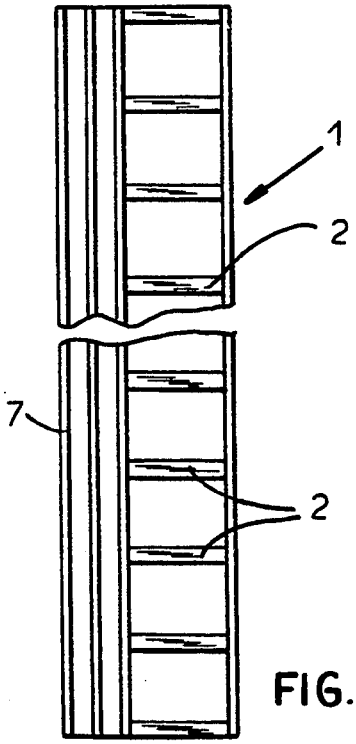
FIG. 2 is a cross-section taken along line II—II of FIG. 1.
Figure 3:
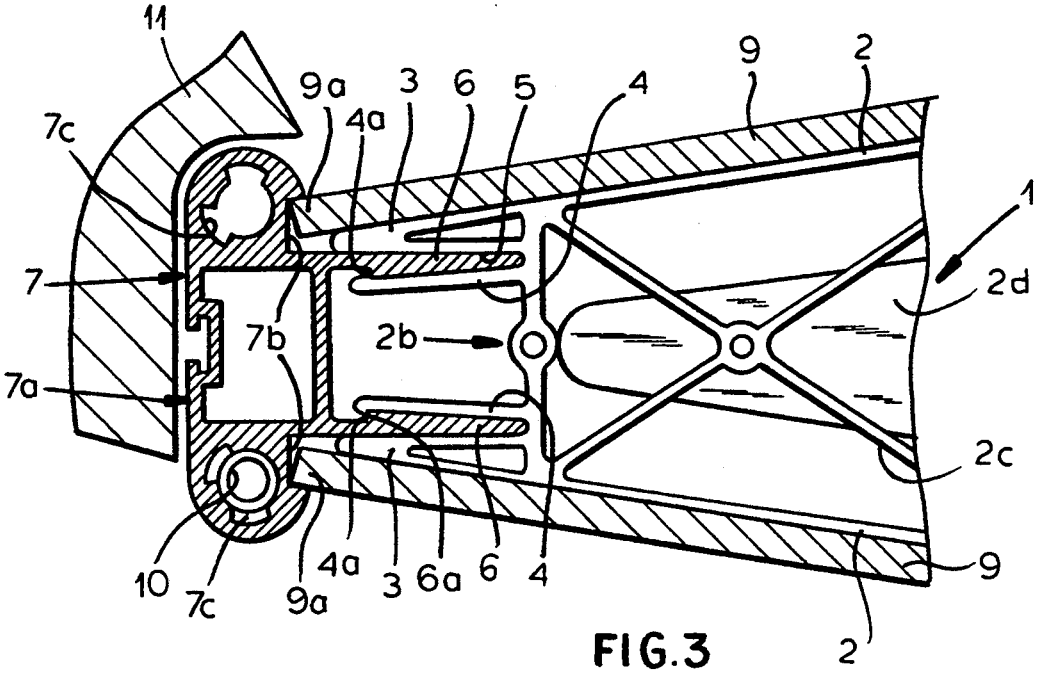
FIG. 3 is a cutaway view taken along line III—III of FIG. 1.

As shown in the drawing, the door according to this invention is comprised of a frame 1 consisting of a series of cross-members 2 located parallel to one another at a preset distance in a vertical sense. The opposite ends 2*a*,2*b* of the cross members are symmetrically formed with two shaped projections 3 parallel to which and in an inner position relative thereto extend two flexible tongues 4, provided with inwardly projecting teeth 4*a* which form, with such projections 3, two pairs of grooves 5 capable of accommodating and retaining, following bending and subsequent resetting of such flexible tongues, two matching projecting tabs 6, provided with matching teeth 6a, of a lateral section 7 which extends lengthwise over the full height of the door and is therefore capable of retaining all the cross-members 2 forming a lateral sealing edge.

In a preferred form of implementation cross-members 2 are each comprised of a section made of plastic material internally stiffened by a lattice 2c and by a solid crosspiece 2*d*.

The lateral section 7 each have additionally a head 7*a* in which are located two pairs of seats 7*b* and 7*c*, the purpose of which will become more clearly apparent from the following.

Figure 4A:
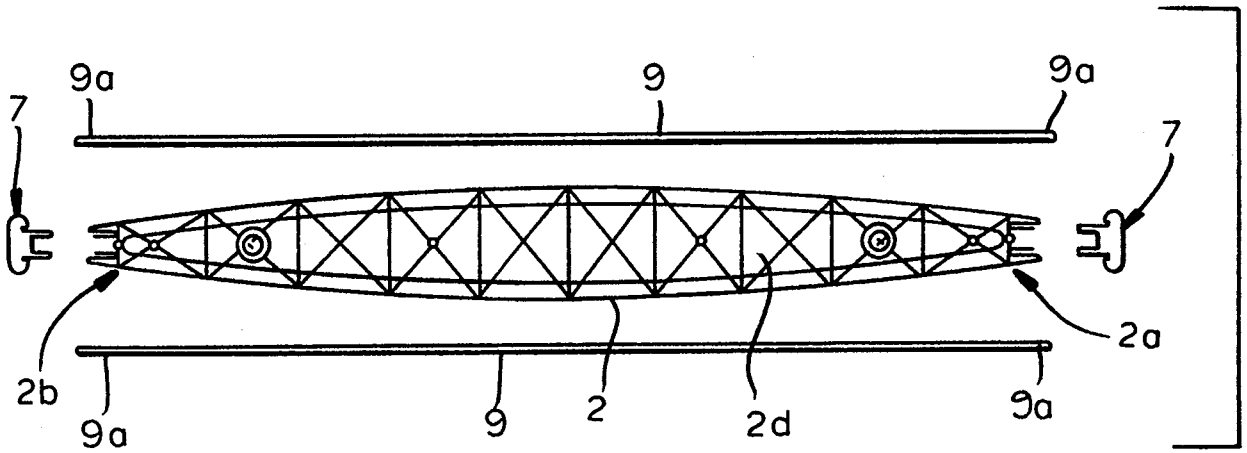
FIG. 4*a* is an end view of the door at the assembly stage shown in exploded view.
Figure 4B:
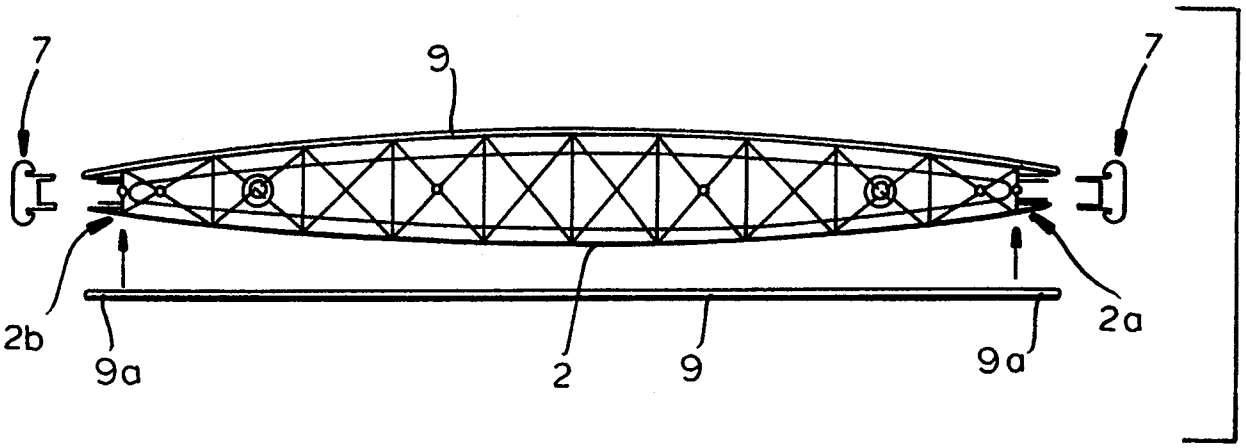
FIG. 4*b* is a view similar to FIG. 4*a* of the partly assembled door.

As illustrated in FIGS. 4*a* and 4*b*, once a series of cross-members 2 is lined up, there are each applied thereto finishing panels 9, initially flat and then curved in order to adhere to members 2 to which they are subsequently glued; longitudinal sections 7 are fitted by pressing tabs 6 into grooves 5 where they are locked by means of the said flexible resetting of tongues 4 and the reciprocal engagement of teeth 4*a* and 6*a*.

Figure 5A:
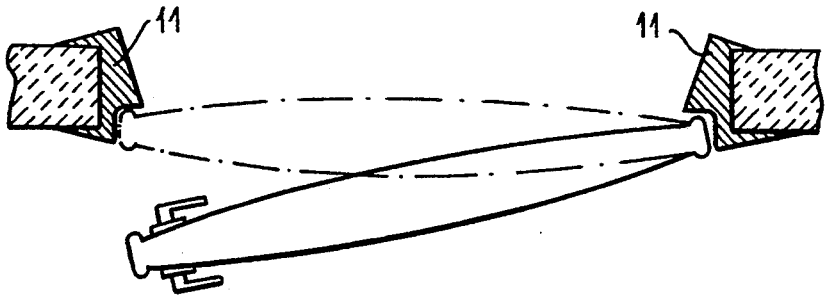
FIGS. 5*a* and 5*b* are sectioned views showing two examples of an outward-opening door with right-hand or left-hand hingeing.
Figure 5B:
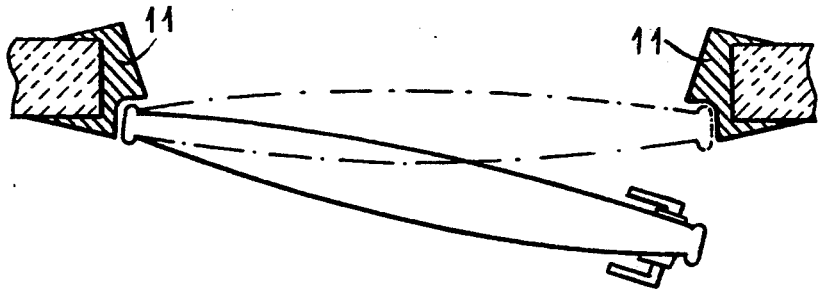

During such joining procedure the free lateral edges 9*a* of panels 9 become inserted in seats 7*b* which cooperate in retaining such panels while at the same time imparting protection to the panels themselves. In such seats 7*c* it is possible to insert hinge units 10 which, by cooperating with non-illustrated matching members applied to frame 11 (FIGS. 5*a* and 5*b*) of the door, allow the rotation thereof for opening and closing; additionally, as a result of the special symmetrical configuration of longitudinal section 7, such hinges may be applied in such a way as to achieve reversibility of the door, which may be arranged for opening outward to the right (FIG. 5*a*) or to the left (FIG. 5*b*) or symmetrically inverted for opening inward, not illustrated.

As can be noted from the figures, a frame according to the invention makes it possible to achieve with simple and rapid assembly operations doors and the like of any cross-section by prearranging the form of the cross-members which, in the example described, have both their outer supporting surfaces of convex shape, this representing one of the cases of greatest production difficulty for veneered panels.

The method for producing a door or similar by means of a frame according to the foregoing description substantially comprises the following phases:

a) preparation of cross-members of suitable form in plan and with lateral edges ready for gluing;
b) presetting in a horizontal plane of a first flat-surface panel;
c) supporting, at preset intervals, a plurality of such cross-members with their lower edges on the flat surface of such first panel;
d) supporting of a second flat-surface panel on the upper surfaces of the cross-members;
e) bending of both panels to a shape, defined by the surfaces of the cross members, for example a flat, convex or concave shape;
f) gluing the panels to such cross-members with possible curvature of the surfaces;
g) application of the longitudinal sections to the flanks of the door thus obtained; and
h) finishing of the external surface of the panels.

Similarly such cross-members may be flat and of any desired size. Obviously many variants may be introduced into the constructional details of the various members without thereby departing from the scope of this invention. In particular there may be varied according to any both the internal structure of the individual cross-members and the types of attachment to the longitudinal section may be varied.

I claim:

1. A method of making a door, comprising the steps of:

(a) disposing a first flat-surface panel in a horizontal plane;
(b) providing a plurality of cross-members each in the form of a pair of curved outer ribs, an internal lattice structure bridging said ribs, and a flat member internally stiffening said lattice structure, said cross-members having connecting formations at opposite ends thereof;
(c) positioning said cross-members at preset intervals on said first flat-surface panel with respective lower ones of said ribs against a surface thereof;
(d) disposing a second flat-surface panel upon said cross-members with respective upper ones of said ribs against a surface thereof;
(e) bending said panels to conform to curvatures of said ribs;
(f) gluing said panels to said cross-members to form an assembly; and
(g) applying longitudinal sections to opposite edges of said assembly by inserting tongues of said sections into said connecting formations and so that said longitudinal sections bridge between the panels at said edges.

2. The method defined in claim 1, further comprising the step of finishing surfaces of said panels turned away from said cross-members.

3. The method defined in claim 2 wherein said surfaces of said panels turned away from said cross-members are finished before said panels are joined to said cross-members.

4. The method defined in claim 2 wherein said surfaces of said panels turned away from said cross-members are finished after said panels are joined to said cross-members.

5. The method defined in claim 1 wherein said ribs are outwardly convex, said panels being bent outwardly convexly in step (e).

6. The method defined in claim 1 wherein said sections have recesses opening toward said assembly, said method further comprising the step of engaging respective edges of said panels in said recesses.

* * * * *